US006540585B1

(12) United States Patent
Lee

(10) Patent No.: US 6,540,585 B1
(45) Date of Patent: Apr. 1, 2003

(54) VENTILATED PADDED LINGERIE

(76) Inventor: William Lee, 23 Victoria Place East, Fort Lee, NJ (US) 07024

( * ) Notice: Subject to any disclaimer, the term of this patent is extended or adjusted under 35 U.S.C. 154(b) by 0 days.

(21) Appl. No.: 09/715,507

(22) Filed: Nov. 17, 2000

(51) Int. Cl.[7] ..... A41C 3/00

(52) U.S. Cl. ..... 450/38; 450/57; 450/55; 2/268; 2/267

(58) Field of Search ..... 450/38, 55–57, 450/37, 39; 2/267, 268, 455, 463

(56) References Cited

U.S. PATENT DOCUMENTS 532,756 A * 1/1895 Bergheim ..... 2/463
2,437,054 A * 3/1948 Tatai ..... 2/267
2,445,767 A * 7/1948 Dickerson ..... 2/463
2,579,365 A * 12/1951 Conde ..... 2/463
2,616,093 A * 11/1952 Talalay ..... 2/267
2,748,771 A * 6/1956 Richards ..... 2/38
2,864,373 A * 12/1958 Buckley ..... 2/38
3,176,686 A * 4/1965 Barnes ..... 2/463
5,032,103 A * 7/1991 Larsson ..... 450/37
5,244,432 A * 9/1993 Moy Au et al. ..... 450/54
5,522,892 A * 6/1996 Lin ..... 450/57 X
5,806,103 A * 9/1998 McCracken et al. ..... 450/57 X

* cited by examiner

*Primary Examiner*—Gloria M. Hale
(74) *Attorney, Agent, or Firm*—Duane Morris LLP

(57) ABSTRACT

A ventilated padded material suitable for providing air circulation in padded lingerie is disclosed. Padded lingerie, for example, bras, typically are made from man-made materials that prevent perspiration from evaporating and then accumulates in the breast cup area. The retained perspiration causes discomfort to the wearer, as the surrounding breast area remains moist and damp. The ventilation channels or perforations in the padding material, in accordance with the principles of the present invention, enable air circulation to occur through the padding material. Increased air circulation through the padding material allows for perspiration evaporation and less accumulated perspiration.

22 Claims, 6 Drawing Sheets

VENTILATED PADDED LINGERIE

FIELD OF THE INVENTION

The present invention relates to padded lingerie and, more specifically, to ventilating and improving air circulation in padded brassieres.

BACKGROUND OF THE INVENTION

New technologies and materials have created revolutionary changes in the clothing men and women wear today. Materials such as, Latex, Lyca, Spandex, polyester, have changed the look, style and feel of clothing, especially exercising and lightweight summer clothing. Today's exercise and summer clothes, for example, are lighter and tend to stretch to fit the contours of a wearer's body. Accordingly, any clothing or objects included under the stretched fabric protrudes through the fabric and creates unsightly lines in the smooth, stretched fabric. For example, manufacturers of woman's lingerie have developed seamless bras and panties to prevent protrusions in stretch dresses, shorts, tank tops, etc. In addition to not being observable under the outer clothing, seamless bras and panties are used to augment, enhance and provide more comfort to the wear's body features. In such cases, padding is added to provide support for and enhance the shape of a woman's breast. Thus, seamless panties and seamless padded bras are ideal lingerie as they do not create unsightly lines in the covering dress, shorts, tank top, etc., fabric while enhancing the wear's appearance.

However, materials used in the creation of seamless bras and panties typically are made from man-made materials, such as nylon, rayon, polyurethane, etc., which retain body heat and perspiration. The padded bra, for example, becomes uncomfortable to wear on warm summer days as the man-made materials used prevent perspiration from evaporating. The unevaporated perspiration then collects in the bra cup area. Hence, there is a need to develop methods to allow remove perspiration in padded lingerie, while maintaining the features of being undetected and providing an enhanced appearance.

SUMMARY OF THE INVENTION

A seamless padded bra, which includes ventilation channels within the padding materials, is disclosed. The ventilation channels, or perforations, within the padding materials provide a means for ventilating the enclosed breast area by allowing air to circulate through the padding material. The circulating air allows for perspiration evaporation around the breast area, consequently, leaving the breast area dry.

Figure 1:
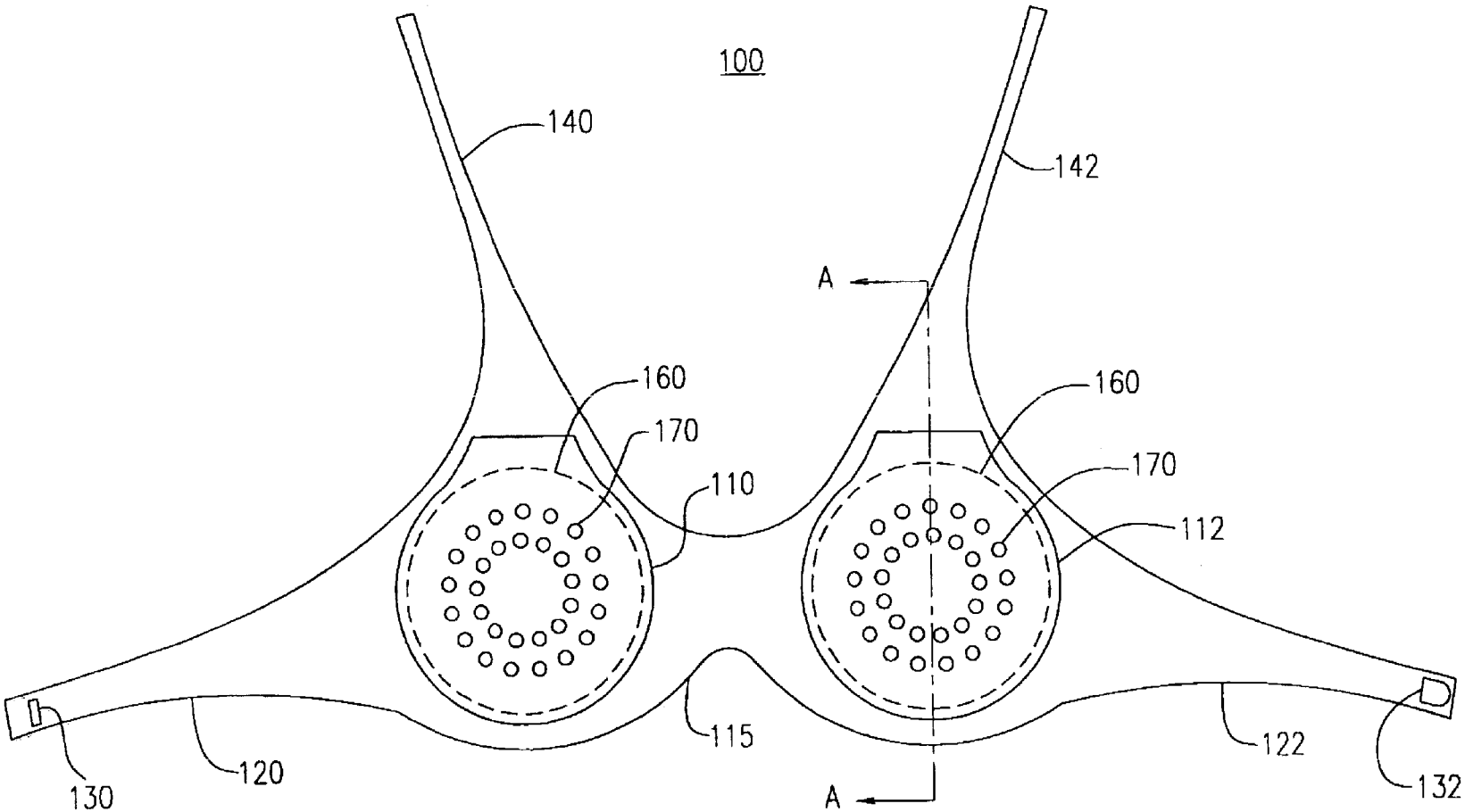
FIG. 1 illustrates a frontal view of an exemplary padded bra in accordance with the principles of the present invention.

It is to be understood that these drawings are solely for purposes of illustrating the concepts of the invention and are not intended as a definition of the limits of the invention. It will be appreciated that the same reference numerals, possibly supplemented with reference characters where appropriate, have been used throughout to identify corresponding parts.

DETAILED DESCRIPTION OF THE INVENTION

Referring to FIG. 1, a frontal view of an exemplary seamless padded bra 100 is illustrated depicting breast cups 110 and 112 lateral displaced along front section 115 and bands 120 and 122 with securing means 130 and 132, respectively. Bands 120 and 122, when conventionally extended across the back of the wearer, and held by securing means 130 and 132, secure bra 100 to the wearer. Straps 140 and 142, attached on one end near breast cups 110 and 112, respectively, and on a second end (not shown) to bands 120 and 122, respectively, provide further support in securing bra 100 to the wearer. Also illustrated within each breast cup 110 and 112, is padding material 160. Padding material 160 provides for a level of support and enhancement that a wearer experiences when wearing bar 100. Padding material 160 further incorporates ventilating channels 170, which allow for air circulation in the breast area, in accordance with the principles of the present invention. In this illustrative example, ventilating channels 170 are symmetrically distribute in two concentric circular arrangements about a center area, which covers a center portion of the breast area.

Figure 2:
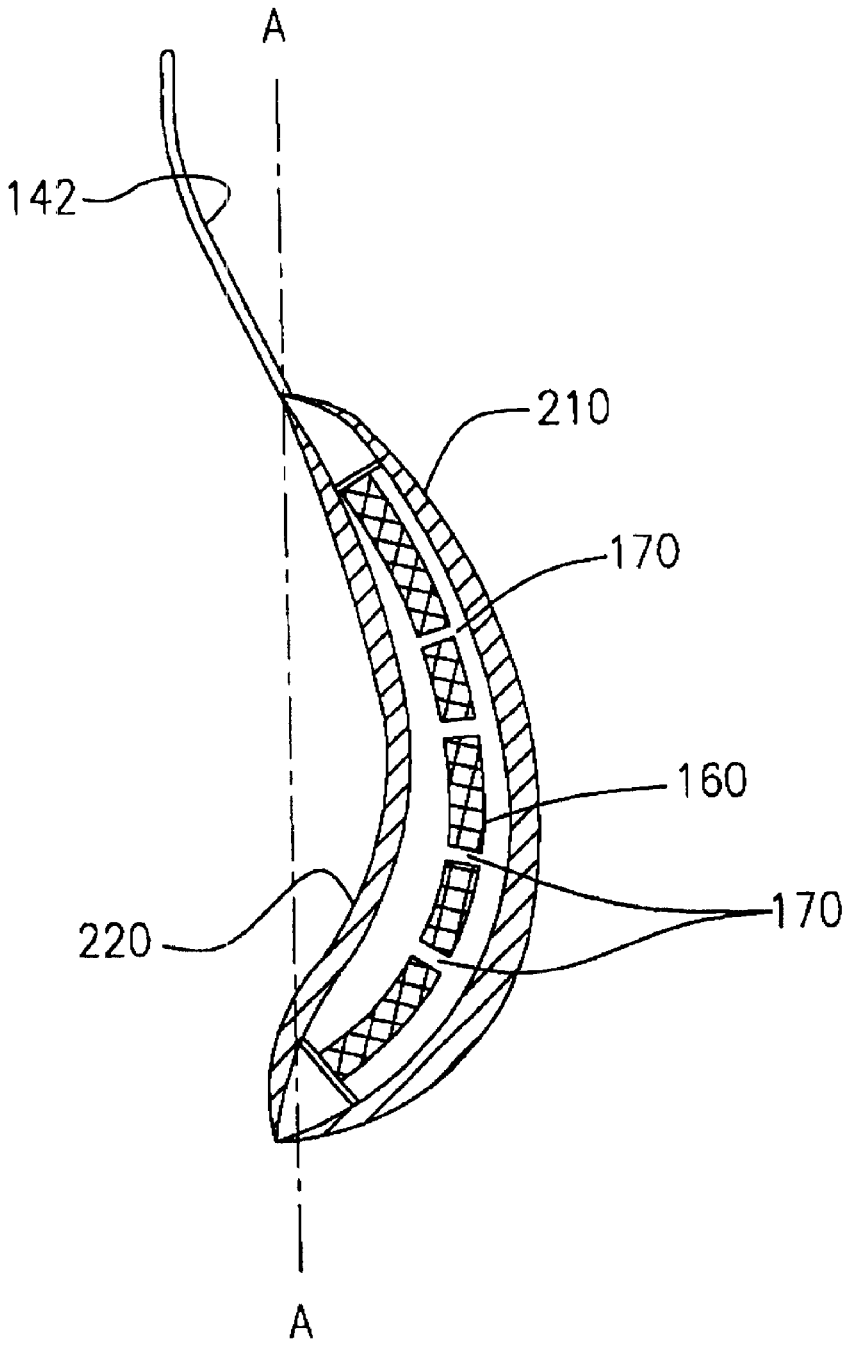
FIG. 2 illustrates a cross-sectional view of the exemplary padded bra illustrated in FIG. 1 sectioned along line A—A.

FIG. 2 illustrates a side view of bra 100 sectioned along section line A—A of FIG. 1. As illustrated, bra 100 is composed of a thin smooth anterior material 210, and a thin smooth posterior material 220. Anterior material 210 and posterior material 220 are rigidly attached along respective perimeters, thereby, creating a cavity therebetween. Also illustrated is padding material 160 enclosed within the cavity created by anterior material 210 and posterior material 220. The amount and shape of padding material 160 determines the level of support and enhancement provided.

To achieve a smooth appearance, anterior material 210 is typically selected as a man-made material, such as Polyester, Lycra, Spandex, etc. Using these man-made materials, the form for bra 100 may be created as single piece, which does not require any switching or seam. Posterior material 220, which is in contact with the breast area, typically is selected as a natural material, such as cotton, silk, etc. Natural materials are selected because natural materials are able to draw perspiration away from the breast area. Enclosed padding material 160 is typically selected as a man-made material, such as polyurethane, foam rubber, etc., as these materials can be formed into shapes that provide different levels of comfort and enhancement. Man-made materials, as is known in the art, do not allow for air circulation within. Therefore, perspiration wicked away from the body by posterior material 220 becomes trapped by padding material 160.

Further illustrated are ventilation channels, or perforations, 170 extending through padding material 160 from anterior material 210 to posterior material 220 to provide for ventilation of the breast area. Ventilating channels 170 provide a means to remove perspiration that was wicked away from the breast area by allowing air circulation through padding material 160.

Figure 3A:
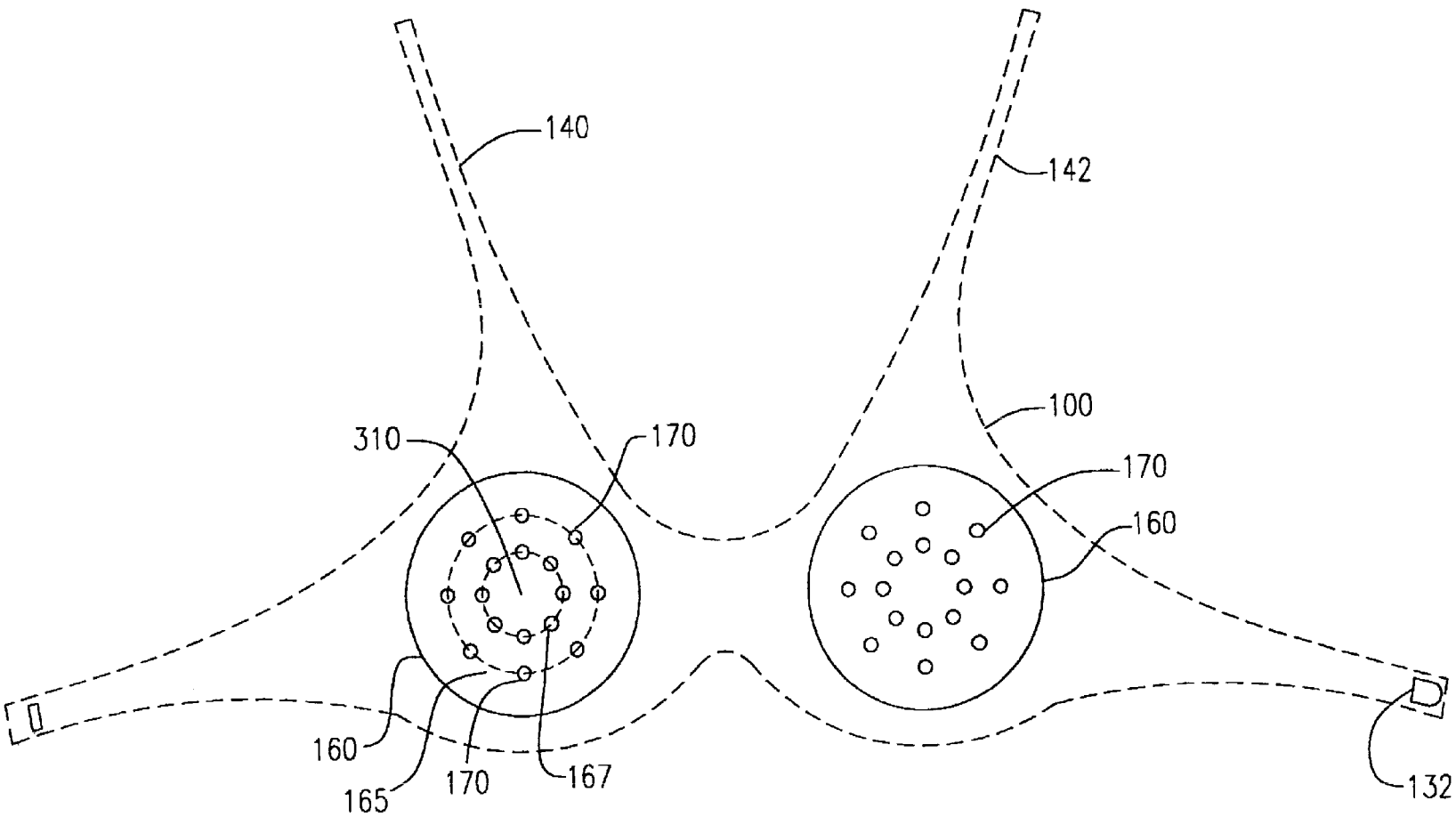
FIGS. 3*a*–3*d* illustrate exemplary padding material ventilated in accordance with the principles of the present invention.

FIG. 3*a* illustrates an exemplary frontal view of bra 100 highlighting specifically padding material 160 and contained ventilating channels 170. In this exemplary embodiment of the invention, ventilating channels 170 are distributed along a plurality of radial lines emanating from apex point 310 of padding material 160. The distribution of ventilating channels along radial lines provides for a substantially symmetric appearance of ventilating channels 170 in material 160. In this illustrative example, ventilating channels 170 are symmetrically distribute in concentric circular arrangements about a center area, which covers a center portion of the breast area. A first group of perforations 170 are distributed along concentric circle represented as dashed line 165. A second group of perforations 170 are distributed along concentric circle represented by dashed line 167. Although, not illustrated, it would appreciated that perforations 170 distributed along concentric circle represented by dashed line 165 and perforations 170 distributed along concentric circle represented by dashed line 167 need not align along radial lines stemming from apex point 310. Furtherstill, the size and number of perforations along each concentric need not the same.

Figure 3B:
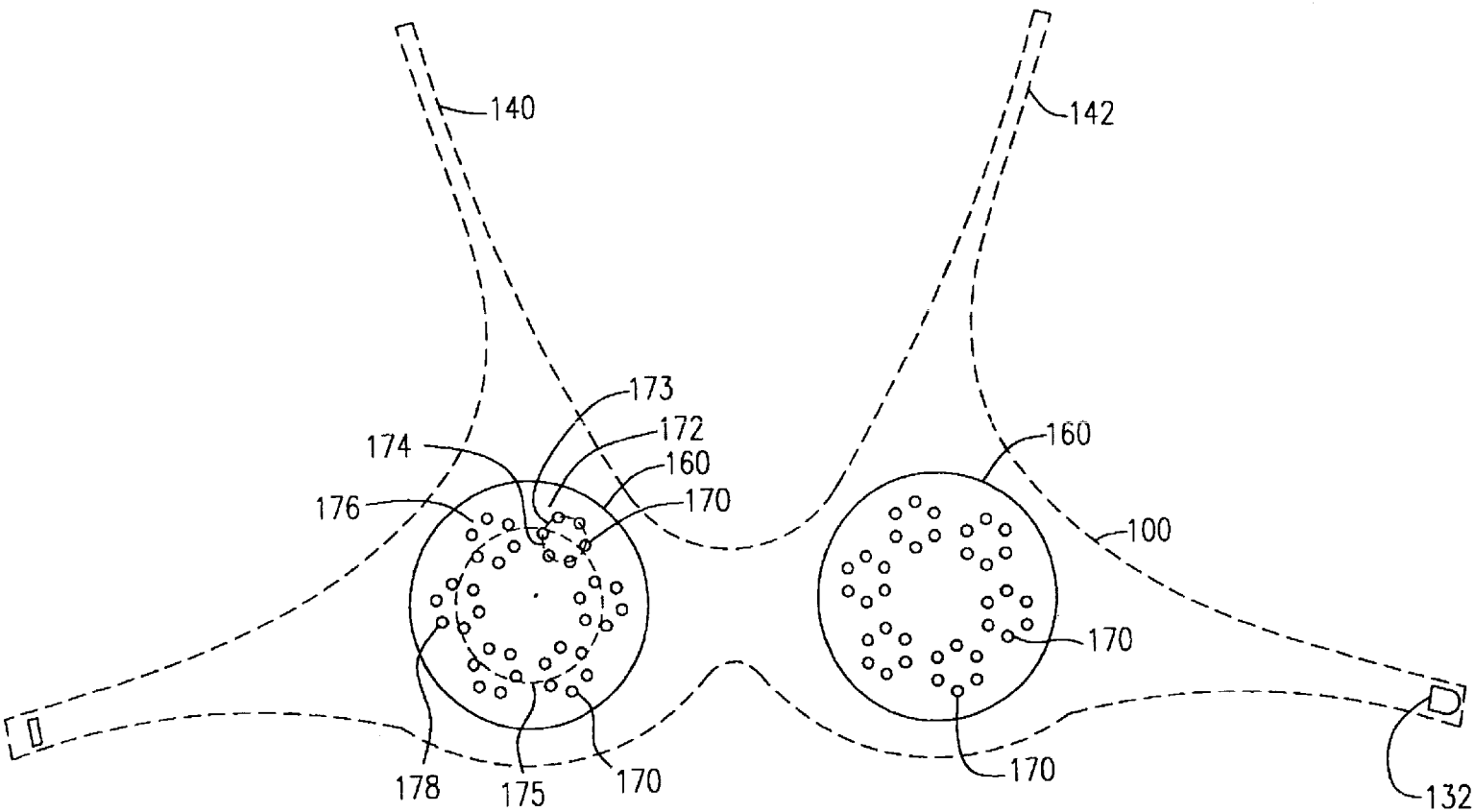

FIG. 3*b* illustrates a second exemplary embodiment of the invention wherein ventilating channels 170 are organized or collected in a plurality of geometric patterns symmetrically distributed in a concentric circular arrangement about a known point 310 in padding material 160. That is, perforations 170 are grouped together, as represented by groups 172, 176 and 178, and distributed in a concentric circular arrangement, as represented by dashed line 175. As would be appreciated, groups 172, 176 and 178 may be distributed in other geometric patterns, such as, triangular, square, rectangular, etc.

Furtherstill, perforations 170 within a selected group may be arranged in a geometric pattern, such as such as circular, triangular, square, rectangular, etc. As illustrated, perforations within group 172, for example, are symmetrically distributed in a circular arrangement as represented by dashed lines 173 and 174. As would be appreciated, ventilating channels groups may be distributed in other geometric patterns, such as, triangular, square, rectangular, etc.

Figure 3C:
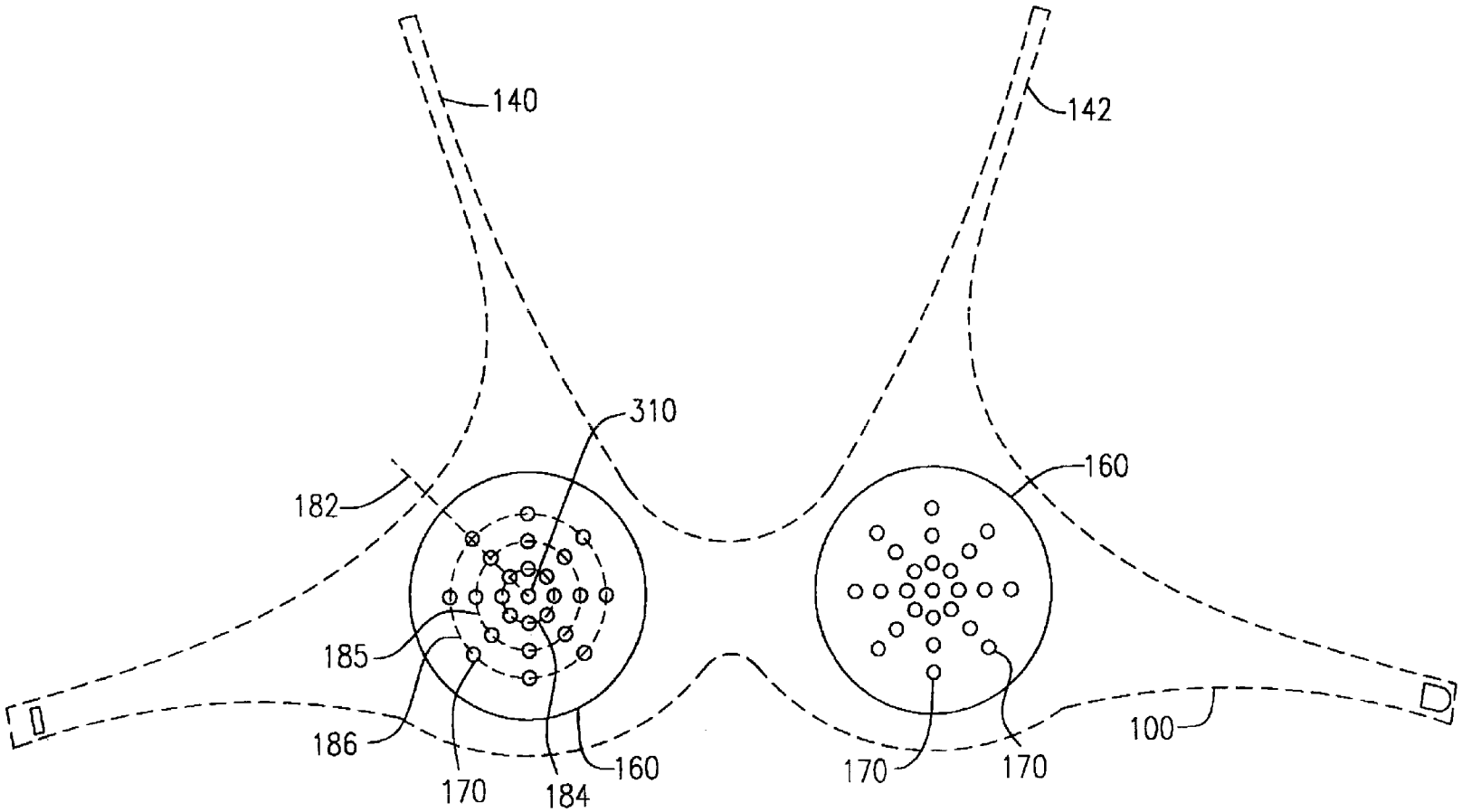

FIG. 3*c* illustrates still another exemplary frontal view of padding material 160 illustrating ventilating channels 170 distributed substantially pattern in a radial pattern from apex point 310. In this exemplary case, perforations 170 are distributed along radial line 182. Perforations 170 are further distributed symmetrically along three concentric circles as represented by dashed lines 184, 185, 185, respectively, about known point 310.

Figure 3D:
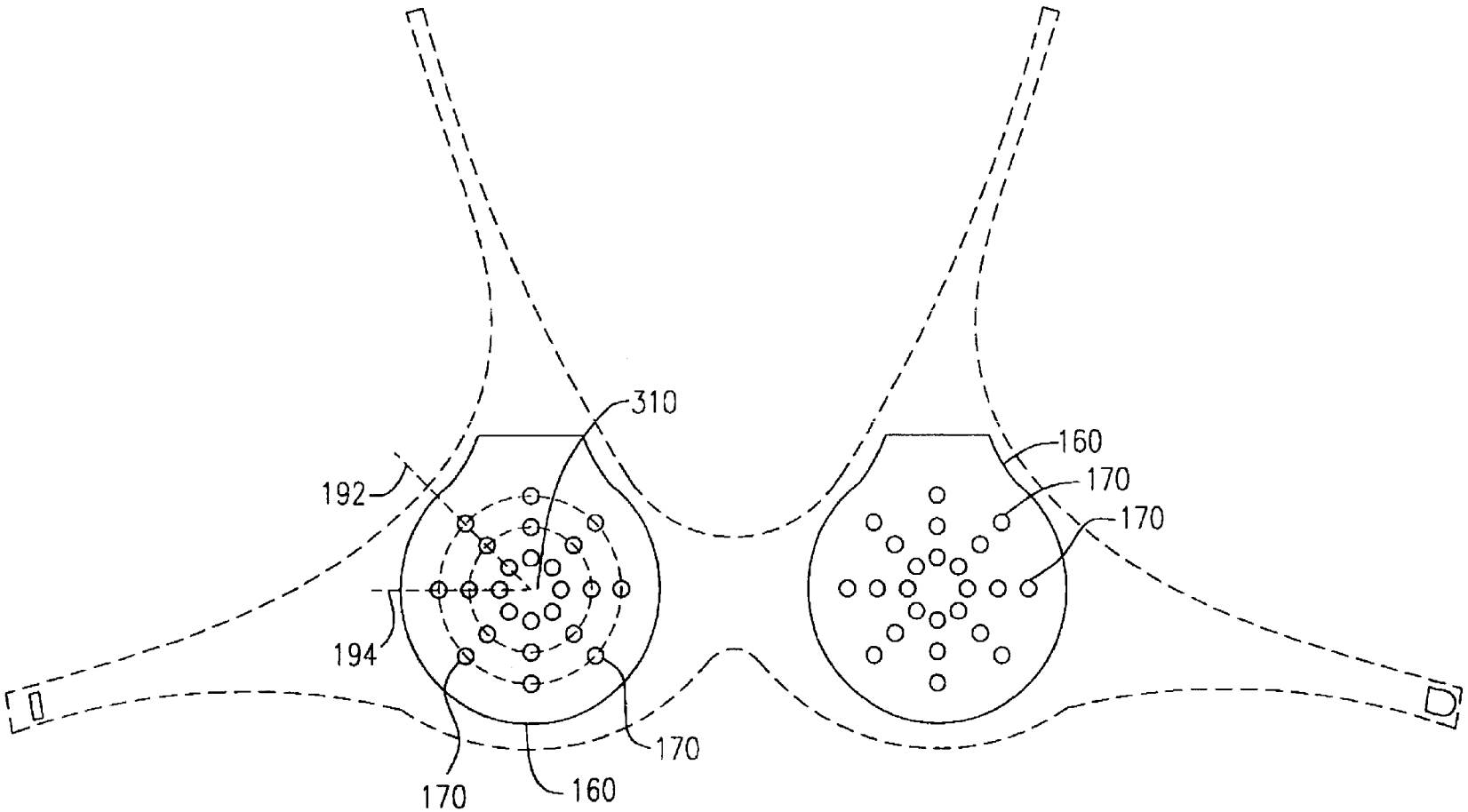

FIG. 3*d* illustrates still another exemplary frontal view of padding material 160 illustrating ventilating channels 170 similar to that illustrated in FIG. 3*c*. In this illustrative embodiment, ventilating channels 170 are distributed along radial lines, e.g., radial line 192 and further distributed along concentric circles. In this example, ventilating channels 170 increase in size as they progress radially outward from apex point 310 along radial line 192, for example. In an alternative embodiment (not shown) perforations 170 may alternate in size on different radial lines stemming from apex point 310. Hence, the ventilating channels distributed along radial 192, for example, may be of a different size than ventilating channels distributed along radial 194.

As would be appreciated, the embodiments of the invention illustrated herein have disclosed symmetric distribution of ventilating channels 170 in padding material 160. Symmetric distribution is preferred as this provides uniform air circulation and ventilation. However, ventilating channels 170 may also be distributed asymmetrically in padding material 160. For example, ventilating channels 170 may be symmetrically or asymmetrically included within only a lower portion of padding material 160 (not shown).

As would be appreciated, the size and number of ventilating channels 170 included in padding material 160 depends on the size if the bra cup enclosing padding material 160. For example, for an "A" size bra cup, the number of ventilating channels 170 may be in the range of 1 to 100. Similarly, for a "D" size bra cup, the number of ventilating channels 170 may be in the range of 2 to 200. Ventilating channel size is in the range one-sixty-fourth (1/64) to one (1) inch. In a preferred embodiment of the invention, the number and size of ventilating channels 170 for a "B" size bra cup is sixty ventilating channels each with a size of one-eight (1/8) of an inch for each cup. Furtherstill, ventilating channels 170 may be also formed in shapes such as square, rectangular, triangular, etc., rather than the circular form illustrative herein.

Although the invention has been described and pictured in a preferred form with a certain degree of particularity, it is understood that the present disclosure of the preferred form, has been made only by way of example, and that numerous changes in the details of construction and combination and arrangement of parts may be made without departing from the spirit and scope of the invention as hereinafter claimed. It is intended that the patent shall cover by suitable expression in the appended claims, whatever features of patentable novelty exist in the invention disclosed.

I claim:

1. A padded brassiere having a back and a plurality of breast portions, each of said breast portions comprising:

an anterior and a posterior material attached along a perimeter forming a cavity therebetween;

a formed padding material encapsulated within said cavity, said padding material being attached along its perimeter to said anterior and posterior materials, said padding material including at least one ventilating channel distributed throughout said padding material in a rectangular pattern.

2. A padded brassiere having a back and a plurality of breast portions, each of said breast portions comprising:

a formed padding material including at least one ventilating channel distributed throughout said padding material in a rectangular pattern; and an anterior and a posterior material attached to said formed padding material.

3. The brassiere as recited in claim 2 further comprising:

a strap having a first end and a second end, wherein said first end being attached to a first one of said breast portions and said second end being attached to said back.

4. A padded brassiere having a back and a plurality of breast portions, each of said breast portions comprising:

an anterior and a posterior material attached along a perimeter forming a cavity therebetween;

a formed padding material encapsulated within said cavity, said padding material being attached along its perimeter to said anterior and posterior materials, said padding material including at least one ventilating channel distributed throughout said padding material.

5. The brassiere as recited in claim 4 wherein said padding material is selected from the group of materials of polyurethane, rubber, Latex.

6. The brassiere as recited in claim 4 wherein said at least one ventilating channel traverses said padding material from said anterior material to said posterior material.

7. The brassiere as recited in claim 4 wherein said at least one ventilating channel is a known size.

8. The brassiere as recited in claim 4 wherein said at least one ventilating channel is symmetrically distributed about a predetermined point within said padding material.

9. The brassiere as recited in claim 4 wherein said at least one ventilating channel is asymmetrically distributed about a predetermined point within said padding material.

10. The brassiere as recited in claim 9 wherein said predetermined point is an apex of said padding material.

11. The brassiere as recited in claim 4 wherein said at least one ventilating channel is radially distributed about a predetermined point within said padding material.

12. The brassiere as recited in claim 11 wherein said predetermined point is an apex of said padding material.

13. The brassiere as recited in claim 4 wherein said at least one ventilating channel is distributed in geometric shapes within said padding material.

14. The brassiere as recited in claim 13 wherein said geometric shapes are selected from the group of comprising: circular, square, rectangular, triangular.

15. The brassiere as recited in claim 6 wherein said at least one ventilating channel shape is selected from the group of circular, square, rectangular, triangular.

16. The brassiere as recited in claim 7 wherein said known size is in the range of one-sixty-fourth (1/64) to one (1) inch.

17. The brassiere as recited in claim 1 wherein said ventilating channels are an alternating size.

18. The brassiere as recited in claim 17 where said alternating size is in the range one-sixty-fourth (1/64) to one (1) inch.

19. The brassiere as recited in claim 1 wherein said at least one ventilating channel is distributed over a portion of said padding material.

20. The brassiere as recited in claim 19 wherein said portion of said padding material is a lower portion.

21. The brassiere as recited in claim 4 wherein said at least one ventilating channel comprises sixty ventilating channels.

22. The brassiere as recited in claim 21 wherein each of said ventilating channel is sized at one-eight of an inch.

* * * * *